United States Patent [19]

Krueger

[11] 4,294,455

[45] Oct. 13, 1981

[54] ROLLER SKATE CONSTRUCTION

[75] Inventor: Arnold F. Krueger, Buffalo, N.Y.

[73] Assignee: M & K Industries, Inc., Buffalo, N.Y.

[21] Appl. No.: 35,242

[22] Filed: May 2, 1979

[51] Int. Cl.[3] ..... A63C 17/02; A63C 17/14

[52] U.S. Cl. ..... 280/11.2; 280/11.19; 280/11.27

[58] Field of Search ..... 280/11.28, 11.27, 11.19, 280/11.26, 11.1 R, 11.2

[56] References Cited

U.S. PATENT DOCUMENTS

| | | | |
|---|---|---|---|
| 1,673,405 | 6/1928 | Davis | 280/11.19 |
| 2,269,362 | 1/1942 | Daniska | 280/11.2 |
| 2,516,644 | 7/1950 | Post et al. | 280/11.2 |
| 2,941,812 | 6/1960 | Reynolds | 280/11.2 |
| 3,250,544 | 5/1966 | Ware | 280/11.2 |
| 3,355,184 | 11/1967 | Green | 280/11.19 |
| 3,738,673 | 6/1973 | Iseman | 280/11.28 |
| 4,168,842 | 9/1979 | Kimmell et al. | 280/11.28 |

FOREIGN PATENT DOCUMENTS

| | | | |
|---|---|---|---|
| 743725 | 1/1956 | United Kingdom | 280/11.2 |
| 792469 | 3/1958 | United Kingdom | 280/11.2 |

*Primary Examiner*—Joseph F. Peters, Jr.
*Assistant Examiner*—Milton L. Smith
*Attorney, Agent, or Firm*—Joseph P. Gastel

[57] ABSTRACT

A roller skate construction including an elongated cast plastic body member having a hollow extending substantially throughout the length thereof and including front and rear axle supporting portions having bores therein with the sides of the bores being diverging so as to act as limit stops for the central portions of the axles which are pivotally mounted by means of bolts extending therethrough and received in the front and rear axle supporting portions. Wear plates are positioned in the bores between the axles and the axle supporting portions to take the wear due to pivotal movement of the axles. A toe stop construction consisting of a substantially solid rectangular block with a slot therein to receive the front portion of a skate body in complementary mating relationship and a bolt nonrotatably extending through the toe stop and the skate body for mounting the toe stop, the configuration of the slot and the toe portion of the skate body being such so that there can be no pivotal movement of the toe stop.

15 Claims, 10 Drawing Figures

Fig. 4.
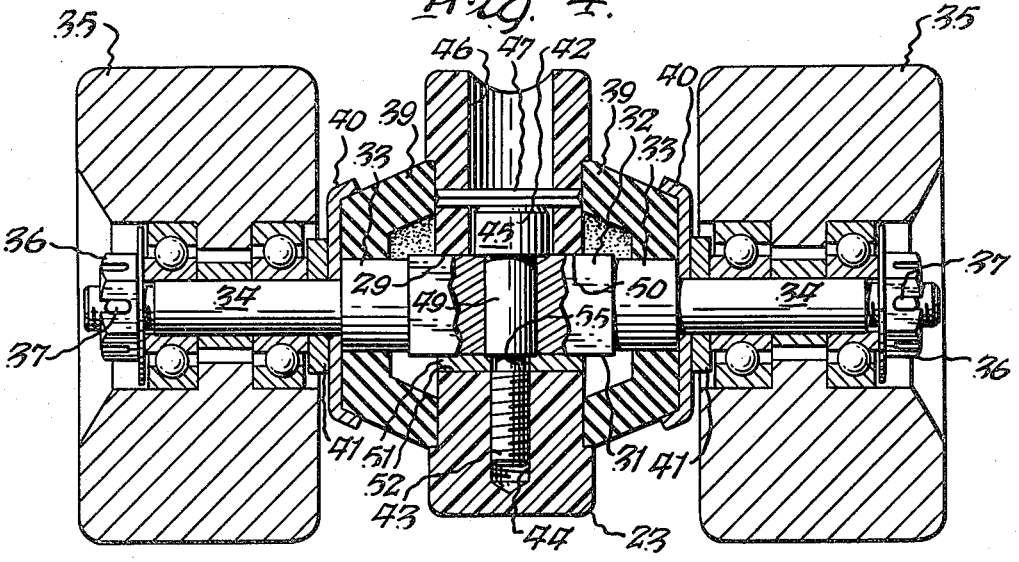
Fig. 5.
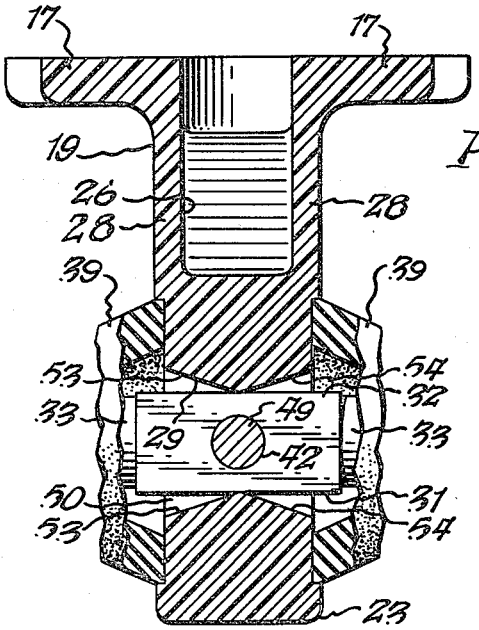
Fig. 6.
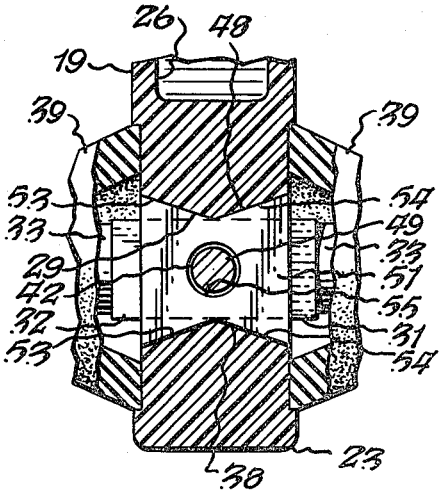
Fig. 7.
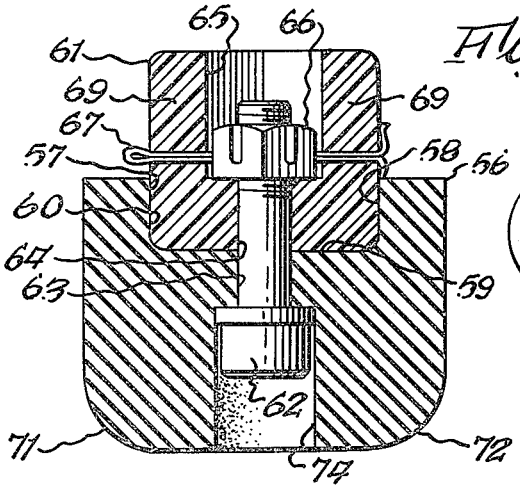
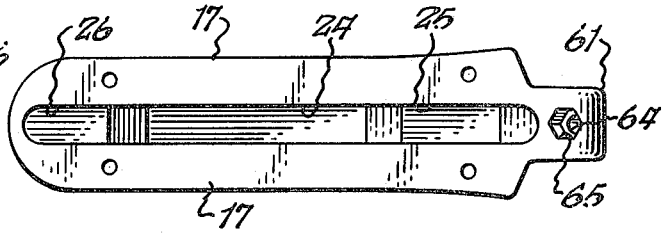
Fig. 8.

ROLLER SKATE CONSTRUCTION

BACKGROUND OF THE INVENTION

The present invention relates to an improved skate construction.

By way of background, a skate such as shown in U.S. Pat. No. 3,738,673 has recently become very popular because of the type of action which it possesses, as described in detail in this patent. However, the construction of the skate shown in this patent is relatively complex and therefore requires considerable time for both assembly and for repair. In addition, prior toe stops used on skates were usually mounted in such a manner that they could rotate on the bolt which attached them to the skate body. This frequently resulted in the toe stop working loose with the attendant possibility of injury to the skater. It is with overcoming the foregoing deficiencies of prior art skates that the present invention is concerned.

SUMMARY OF THE INVENTION

It is one object of the present invention to provide a highly simplified skate construction of the type in which the axles pivot about a center pin so as to greatly reduce the complexity of the skate, thereby lessening its cost, and shortening the time for assembly and repair.

Another object of the present invention is to provide an improved toe stop construction which is unlikely to loosen in use, thereby greatly minimizing accidents which result from loose toe stops. Other objects and attendant advantages of the present invention will readily be perceived hereinafter.

The improved roller skate construction of the present invention comprises an elongated plastic body member including front and rear axle supporting portions, first and second bores in said front and rear axle supporting portions, respectively, first and second axles extending through said first and second bores, respectively, first and second axle supporting bolts extending perpendicularly through said first and second axles, respectively, in said front and rear axle supporting portions, respectively, and first and second wear plates in said first and second bores, respectively, interposed between said first and second axles, respectively and said front and rear axle supporting portions, respectively, for bearing the load of said first and second axles, respectively.

The present invention also comprises a toe stop construction for a roller skate comprising a body portion having a top and a bottom, an elongated slot in said top for receiving the front portion of a skate body in substantially complementary mating relationship, and bolt-receiving bore means in said bottom extending substantially perpendicularly to said slot for receiving a bolt, said front portion of said skate and said slot being non-circular so as to prevent said toe stop from pivoting about the axis of said bolt.

The various aspects of the present invention will be more fully understood when the following portions of the specification are read in conjunction with the accompanying drawings wherein:

BRIEF DESCRIPTION OF THE DRAWINGS

FIG. 4 is a cross sectional view taken substantially along line 4—4 of FIG. 3 and showing the manner in which the axle is mounted on the skate body and also showing the wheels mounted on the axle;

FIG. 5 is a fragmentary cross sectional view taken substantially along line 5—5 of FIG. 3 and showing the relationship between the central portion of the axle and the axle limit stops molded into the axle supporting portion of the skate body;

FIG. 6 is a fragmentary cross sectional view taken substantially along line 6—6 of FIG. 3 and showing the configuration of the wear plate and its relationship to the bore in which it is mounted;

FIG. 7 is a cross sectional view taken substantially along line 7—7 of FIG. 3 and showing the construction of the improved toe stop of the present invention;

FIG. 8 is a reduced plan view looking downwardly at the top of the skate body.

DESCRIPTION OF THE PREFERRED EMBODIMENTS

Figure 1:
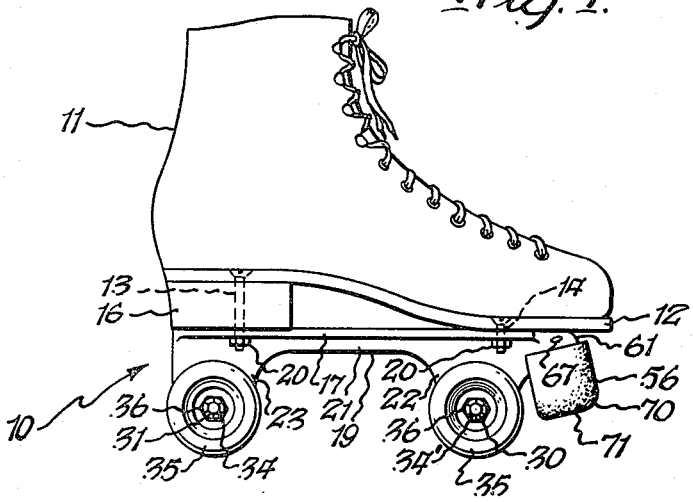
FIG. 1 is a side elevational view of the improved roller skate construction of the present invention mounted on a shoe.
Figure 1A:
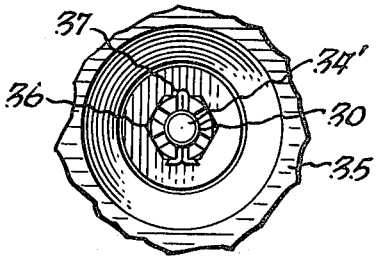
FIG. 1*a* is a fragmentary enlarged view showing the nut-cotter pin connection for retaining the wheel on the axle.

The improved skate 10 of the present invention is adapted to be mounted on shoe 11 having a sole 12 by means of rear spaced bolts 13 and front spaced bolts 14 which extend through heel 16 and sole 12, respectively. Bolts 14 and 15 also extend through flanges 17 of skate body 19. Nuts 20 are mounted on bolts 13 and 14 to secure the skate body 19 securely in position on the shoe. The skate body 19 is cast integrally from nylon or any other suitable plastic. The body 19 includes an elongated central portion 21 having formed integrally therewith front axle mounting portion 22 and rear axle mounting portion 23. A hollow 24 is formed in central portion 21 and this hollow continues on into hollow portions 25 and 26 which are located proximate the front and rear axle supporting portions, respectively. By molding body member 19 with the hollows therein, material is conserved and the skate is made relatively lightweight. Furthermore, by making the vertical walls bordering hollows 24, 25 and 26 of substantially equal thickness, warping of the skate body is minimized (see FIG. 5). The vertical walls 28 are of substantially the same thickness as flanges 17.

Figure 3:
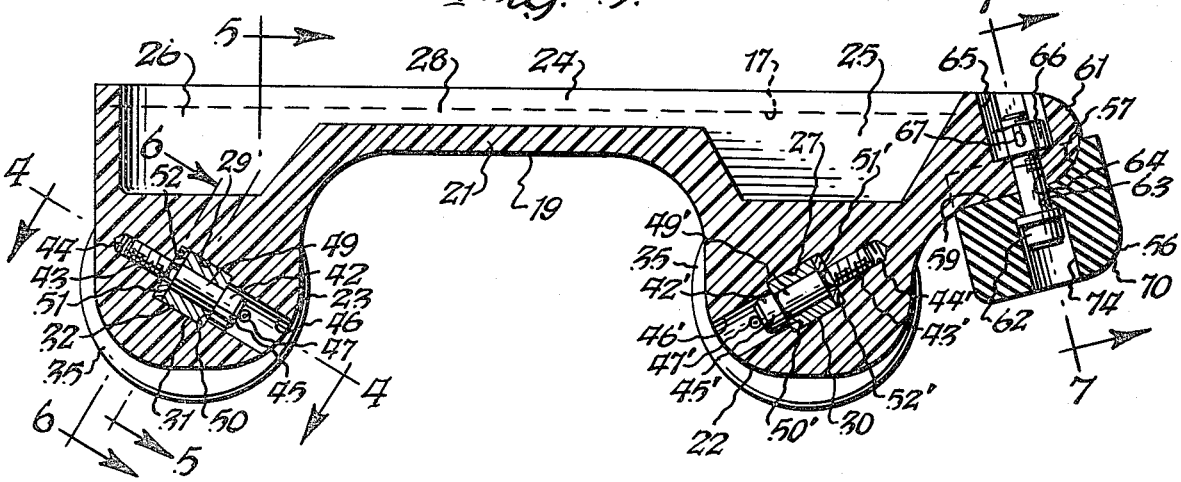
FIG. 3 is a cross sectional view taken substantially along line 3—3 of FIG. 2.

Front axle supporting portion 22 includes a bore 27 formed during the molding process and rear axle supporting portion 23 also includes a bore 29 formed during the molding process. As can be seen from FIG. 3, the bore 29 is inclined along the axis represented by line 4—4 in bore 27 is inclined in an analogous manner. This inclination provides the type of action described in detail in prior U.S. Pat. No. 3,738,673. At this point it is to be noted that the front axle 30 is mounted in a manner analogous to rear axle 31 and therefore the following portion of the description will refer only to the structure associated with rear axle 31, and it will be understood that all parts of axle 30 are the same as axle 31 and that analogous structure on the skate body is associated with both axle 31 and axle 30.

Axle 31 includes a central portion 32 (FIG. 4) which is in the shape of a rectangular solid and which is substantially square in cross section. Reduced cylindrical portions 33 are located on opposite sides of central portion 32 and cylindrical axle portions 34 extend outwardly from portions 33. Wheels 35, having a suitable bearing structure therein, are mounted on axle portions 34 and are secured thereon by nuts 36, each of which has a cotter key 37 associated therewith and extending through axle portions 34. The use of a cotter key with each nut 36 prevents the nuts 36 from loosening in use. Frustoconical resilient bushings 39 of suitable hardness are mounted on shaft portions 33 and bear against the opposite sides of axle supporting portions 22 and 23. Bushings 39 are received in counterbores, not numbered, on opposite sides of the axle supporting portions. Metal washers 40 are mounted on the outer ends of bushings 39 and washers 41 are interposed between washers 40 and the hubs of the skate wheels.

Figure 9:
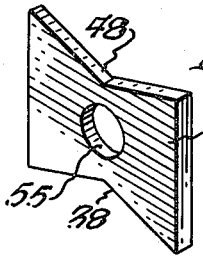
FIG. 9 is a perspective view of the wear plate shown in plan in FIG. 6.

Axle 31 is secured in position by bolt 42 which has its threaded end 43 received in a blind tapped bore 44. The head 45 of bolt 42 is received in counterbore 46 and a pin 47 extends across head 45 to prevent it from becoming loosened in use. It can be seen from FIG. 4 that pin 47 is held in position in bores in axle supporting portion 23 by the opposite bushings 39. Portion 49 of bolt 42 pivotally mounts the central portion 32 of the axle through which it extends. As can be seen from FIGS. 3 and 4, one flat side of axle portion 31 bears against wall 50 of bore 29 and the other side bears against metal wear plate 51 which in turn bears against wall 52. It can readily be seen that wear plate 51 receives the vertical vector of the force applied to the axle, and thereby reduces the wear which wall 52 would experience as a result of the pivotal action of axle 31. As can be seen from FIGS. 6 and 9, wear plate 51 is of butterfly shape and it has a hole 55 therein through which a portion of bolt 42 extends. Furthermore, the outer butterfly-shaped sides 38 and 48 of wear plate 51 fit in complementary mating relationship with the diverging pairs of sides 53—53 and 54—54 (FIG. 6) formed within axle supporting portion 23. Sides 53—53 and 54—54 act as limit stops for limiting pivotal movement of the central portion 32 of axle 31. The fact that the wear plate 51 and the opening in which it fits are of complementary shape aids in retaining wear plate 51 in position.

It will readily be appreciated from a comparison of the above-described subject matter and the subject matter shown in prior U.S. Pat. No. 3,738,673, that the structure of the present skate is greatly simplified in that it has fewer parts and it is accordingly much simpler to assemble and maintain, notwithstanding that the outer appearance of both skates is very similar.

As noted above, the front axle 30 is mounted in an identical manner as rear axle 31 and accordingly a detailed description will not be made other than to designate by primed numerals elements of structure which correspond to those elements which are designated by unprimed numerals relative to rear axle mounting portion 23 and axle 31.

Figure 2:
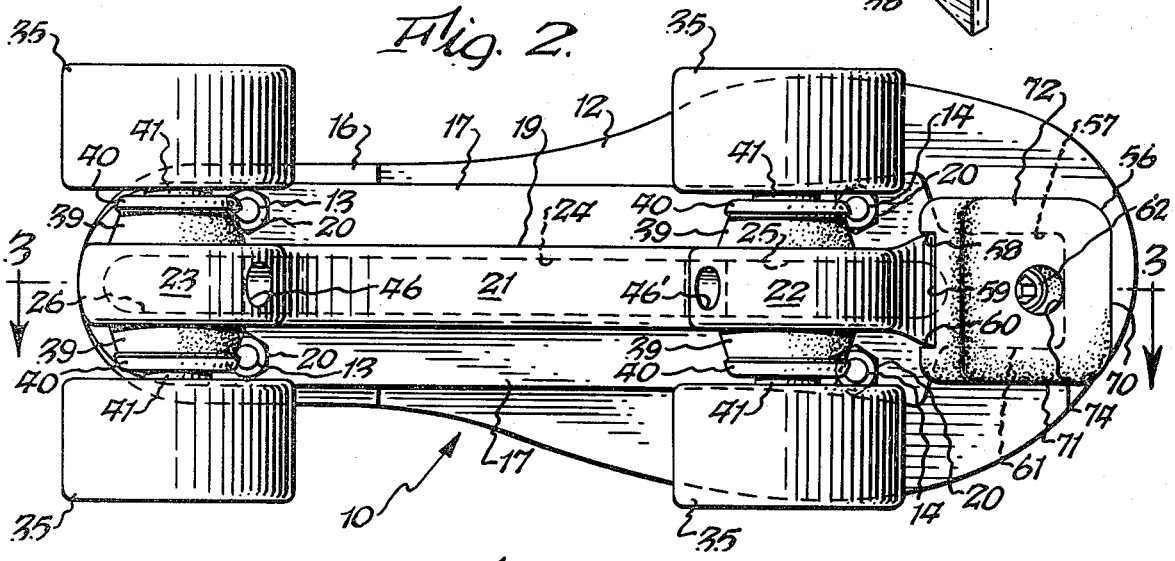
FIG. 2 is a plan view of the roller skate construction of FIG. 1 looking upwardly at the sole of the shoe.

Another aspect of the present invention is the improved toe stop 56 (FIG. 7) which is fabricated from a block of rubber or suitable plastic. Block 56 is essentially of rectangular solid configuration and it has a slot 57 therein defined by sides 58, 59 and 60 for receiving the front portion 61 of skate body 19 in complementary mating relationship, as can be visualized from FIGS. 2, 3 and 7. Because of this complementary mating relationship, toe stop 56 cannot pivot about the axis of bolt 62 which extends through bore 63 in toe stop 56, and also extends through bore 64 in skate body toe portion 61 and is received in hexagonal counterbore 65 in skate body toe portion 61. The head of bolt 62 is received in counterbore 74. A hexagonal nut 66 is housed within hexagonal bore 65 and a cotter key 67 extends through aligned openings in skate toe sides 69, nut 66, and bolt 62, to thereby prevent bolt 62 from turning, and becoming unloosened.

Toe stop 56 includes a rounded front edge 70 and rounded side edges 71 and 72 which are utilized in the conventional manner during skating. It is to be especially noted again that toe stop 56 cannot pivot about the axis of bolt 62 because of the complementary mating relationship between the toe stop and the toe portion of the skate body, and further bolt 62 cannot work its way loose because of its locked-in connection described above. Therefore, the possiblity of accident due to malfunction of the toe stop is virtually eliminated.

One type of NYLON which was used to make a skate body is known under the trademark ZYTEL of the DuPont Company and is further identified as FE 3189 Natural. The NYLON which was used provides light weight and flexilibity and is highly resistant to cracking and fracture. In addition, it absorbs shocks experienced during skating. Because of the light weight the skater experiences a good "feel" and has good control. A pair of skates, exclusive of shoes, made in accordance with the present invention weighs about two pounds whereas a pair of comparable metal skates weighs about six pounds.

While preferred embodiments of the present invention have been disclosed, it is to be understood that the present invention is not limited thereto, but may be otherwise embodied within the scope of the following claims.

What is claimed is:

1. A roller skate construction comprising an elongated cast plastic body member including front and rear axle supporting portions, first and second bores in said front and rear axle supporting portions, respectively, first and second axles extending through said first and second bores, respectively, first and second axle supporting bolts extending perpendicularly through said first and second axles, respectively, in said front and rear axle supporting portions, respectively, first and second wear plates in said first and second bores, respectively, interposed between said first and second axles, respectively, and said front and rear axle supporting portions, respectively, for bearing the load of said first and second axles, respectively, said first and second axles including a rectangular solid central portion through which said first and second axle supporting bolts, respectively, extend, and flat planar portions defining the sides of said first and second bores and diverging away from said rectangular solid central portions on opposite sides of a plane extending perpendicularly thereto and passing through the axis of said first and second bolts, said flat planar portions providing limit stops for limiting pivotal movement of said first and second axles, respectively.

2. A roller skate construction as set forth in claim 1 wherein said first and second wear plates are of butterfly shape in plane with said plane passing through the narrowest portion of said butterfly, said first and second wear plates fitting in complementary mating relationship with said diverging planar sides of said first and second bores, respectively, and receiving said first and second bolts, respectively, therethrough.

3. A roller skate construction as set forth in claim 2 wherein said first and second bolts are received in blind bores in said front and rear axle supporting portions, respectively.

4. A roller skate construction as set forth in claim 3 including a pair of substantially parallel flanges for attachment to a shoe, and a hollow in said body portion between said flanges and extending substantially the entire length of said body portion and for a substantial portion of the depth of said body portion.

5. A roller skate construction as set forth in claim 4 wherein the thickness of a substantial number of the portions of said body portion bordering said hollow are of substantially uniform thickness.

6. A roller skate construction as set forth in claim 5 wherein said hollow extends into the upper portions of said front and rear axle supporting portions.

7. A cast plastic skate body comprising a central body portion, front and rear axle supporting portions integral with said central body portion, first and second elongated substantially parallel flanges extending substantially the entire length of said central body portion for mounting on a shoe, a hollow in said central body portion between said flanges, first and second substantially parallel walls on said central body portion on the opposite sides of said hollow merging into said first and second flanges, respectively, first and second bores cast integrally with said front and rear axle supporting portions, respectively, a front and rear blind tapped bore in said front and rear axle supporting portions, respectively, a front and rear counterbore in alignment with said front and rear blind tapped bore, respectively, and first and second pairs of diverging side walls in each of said first and second bores, respectively.

8. A cast plastic skate body as set forth in claim 7 wherein said hollow extends into said front and rear axle supporting portions.

9. A cast plastic skate body as set forth in claim 7 wherein said flanges and said walls are of substantial equal thickness.

10. A cast plastic skate body comprising a central body portion, front and rear axle supporting portions integral with said central body portion, first and second elongated substantially parallel flanges extending substantially the entire length of said central body portion for mounting on a shoe, a hollow in said central body portion between said flanges, first and second substantially parallel walls on said central body portion on the opposite sides of said hollow merging into said first and second flanges, respectively, first and second bores extending through said front and rear axle supporting portions, respectively, and a pair of first walls and a pair of second walls forming the sides of each of said first and second bores, respectively, each of said first walls and said second walls diverging away from a plane which extends transversely to both said first and second bores.

11. A cast plastic skate body as set forth in claim 10 wherein said hollow extends into said front and rear axle supporting portions.

12. A cast plastic skate body as set forth in claim 11 wherein said flanges and walls are of substantial equal thickness.

13. A skate body comprising a central body portion having a longitudinal axis, front and rear axle supporting portions on said central body portion, means for mounting said skate body on a shoe, first and second bores extending through said front and rear axle supporting portions, respectively, in a direction transverse to said longitudinal axis, first and second axles extending through said first and second bores, respectively, first and second axle supporting bolts extending perpendicularly through said first and second axles, respectively, in said front and rear axle supporting portions, respectively, for pivotally mounting said first and second axles, respectively, said axle supporting bolts lying in a vertical plane, said first and second walls forming the sides of each of said first and second bores, respectively, said first and second walls each including surface means inclined to said plane for limiting pivotal movement of said first and second axles.

14. A skate body as set forth in claim 13 wherein said surface means comprise a pair of wall portions diverging from opposite sides of said vertical plane.

15. A toe stop construction for a roller skate comprising in combination a skate body, a front body portion of noncircular form in plan on said skate body, said front body portion having a pair of sides defining the outer limits of said front body portion, and a front extending transversely thereto, a toe stop having a top and a bottom, an elongated slot in said top for receiving at least said sides of said front body portion in abutting relationship, a bolt-receiving bore in said bottom extending transversely to said slot for receiving a bolt which is also received in said front body portion, said elongated slot being of sufficient depth so as to preclude said toe stop from pivoting about the axis of said bolt, a second bolt-receiving bore in said front body portion aligned with said bolt-receiving bore in said bottom of said toe stop, a counterbore of noncircular configuration in said front body portion, a nut in said counterbore, said nut being of a configuration to be engaged by said counterbore and held against rotation therein, and a pin extending through said nut and bolt and front body portion to lock said bolt in position.

* * * * *

UNITED STATES PATENT AND TRADEMARK OFFICE

CERTIFICATE OF CORRECTION

PATENT NO. : 4,294,455

DATED : October 13, 1981

INVENTOR(S) : Arnold F. Krueger

It is certified that error appears in the above-identified patent and that said Letters Patent are hereby corrected as shown below:

Column 6, line 25, (claim 13), change "said" to --and--.

Signed and Sealed this

*Twenty-ninth* Day of *December 1981*

[SEAL]

*Attest:*

GERALD J. MOSSINGHOFF

*Attesting Officer*

*Commissioner of Patents and Trademarks*